United States Patent [19]

Hiraga et al.

[11] 4,290,345

[45] Sep. 22, 1981

[54] REFRIGERANT COMPRESSORS

[75] Inventors: Masaharu Hiraga; Seishi Kimura, both of Isesaki, Japan

[73] Assignee: Sankyo Electric Company Limited, Isesaki, Japan

[21] Appl. No.: 20,436

[22] Filed: Mar. 14, 1979

[30] Foreign Application Priority Data

Mar. 17, 1978 [JP] Japan ..... 53-29873
Mar. 17, 1978 [JP] Japan ..... 53-29874

[51] Int. Cl.[3] ..... F01B 31/00; F04B 1/18; F04B 39/04

[52] U.S. Cl. ..... 92/79; 417/269

[58] Field of Search ..... 417/269, 437; 92/79

[56] References Cited

U.S. PATENT DOCUMENTS

| | | | |
|---|---|---|---|
| 1,548,517 | 8/1925 | Dubrouin | 62/470 |
| 1,726,178 | 8/1929 | Davenport | 62/470 |
| 2,835,436 | 5/1958 | Steinhagen et al. | 92/79 |
| 3,587,406 | 6/1971 | Gannaway | 417/437 |
| 3,676,024 | 7/1972 | Akaiki | 62/469 |
| 3,838,942 | 10/1974 | Pokorny | 417/269 |
| 3,930,758 | 1/1976 | Park | 417/269 |
| 4,073,603 | 2/1978 | Abendschein | 417/270 |
| 4,127,363 | 11/1978 | Kato | 417/269 |
| 4,135,862 | 1/1979 | Degawa | 417/269 |

*Primary Examiner*—William L. Freeh
*Attorney, Agent, or Firm*—Hopgood, Calimafde, Kalil, Blaustein & Judlowe

[57] ABSTRACT

A refrigerant compressor comprising a balance hole communicating between a crank chamber and a suction chamber for returning the blow-by gas in the crank chamber to suction chamber, is provided with an oil separating member in a discharge chamber to separate oil in the compressed refrigerant gas. The separated oil is accumulated in an accumulating zone in the discharge chamber and returns to the crank chamber through an oil flowing passageway which communicates between the accumulating zone and the crank chamber thereby to reduce the oil leakage into the refrigerant circulating system.

10 Claims, 9 Drawing Figures

REFRIGERANT COMPRESSORS

BACKGROUND OF THE INVENTION

This invention relates generally to refrigerant compressor units and, in particular, to a refrigerant compressor in which oil is separated from the compressed refrigerant gas.

A conventional refrigerant compressor unit comprises a compressor housing, a cylinder block mounted therein and having a plurality of cylinders, and a plurality of pistons respectively, slidably and closely fitted within the cylinders. The pistons are driven within the cylinders to compress refrigerant gas. The compressor housing includes a chamber adjacent the cylinder block for containing piston driving elements, and a cylinder head having a suction chamber and a discharge chamber which operatively communicate with the cylinders.

A charge of refrigerant gas and lubricating oil is introduced into the compressor unit. In the operation operation of the compressor, the refrigerant gas is compressed by the pistons reciprocating within corresponding cylinders. The compressed refrigerant gas circulates from the discharge chamber through a cooling system and returns to the compressor unit at the suction chamber. The lubricant oil passes into the crank chamber together with the refrigerant gas as a blow-by gas through a gap between the piston and the inner wall of the corresponding cylinder to lubricate therebetween. The lubricant oil is separated from the refrigerant gas in the crank chamber and lubricates moving parts therein.

In order to return the blow-by gas into the suction chamber, the conventional compressor unit is provided with a passageway or a balance hole which communicates between the crank chamber and the suction chamber. Accordingly, the lubricant oil also returns to the suction chamber to lubricate the pistons and cylinders.

However, the oil mixed with the refrigerant gas goes out from an outlet port and circulates in the cooling system and contaminates the inner wall of conduits in that system. This means not only that lubricant oil is wasted unreasonably, but also that the efficiency of heat exchange in the system is lowered.

SUMMARY OF THE INVENTION

It is an object of this invention is to provide a refrigerant compressor unit wherein the oil mixed with the compressed refrigerant gas is prevented from circulating through the cooling system together with the refrigerant gas.

It is another object of this invention is to provide a refrigerant compressor in which a significant decrease in the waste of lubricant oil is achieved along with an increase in the efficiency of heat exchange in the cooling system.

It is still another object of this invention to realize these objects in a simple construction.

In one aspect of this invention, a refrigerant compressor unit includes a drive shaft, a cam rotor mounted on an inner end of the shaft and a, wobble plate mounted on an inclined surface of the cam rotor through a radial needle bearing. The wobble plate is connected with a plurality of pistons by respective piston rods, and a bearing ball for nutatably supporting the wobble plate is seated in a ball seat supported by the cylinder block. Means are provided within the discharge chamber of the compressor unit for separating oil from the compressed refrigerant gas. To this end, an oil accumulating chamber is formed within the discharge chamber, and an oil passageway is formed in the cylinder block which communicates between the oil accumulating chamber and the ball seat, whereby the separated oil is returned to the crank chamber where it lubricates the bearing ball.

In another aspect of this invention, the oil returning passageway is so provided that the separated oil is introduced from the oil accumulating chamber to a shaft seal cavity through which the drive shaft extends outside of the compressor housing, whereby the oil returns to the crank chamber after lubricating the shaft seal assembly and the bearing supporting the drive shaft.

Further objects, features and other aspects of this invention will be understood from the following detailed description of preferred embodiments of this invention referring to annexed drawings.

DETAILED DESCRIPTION OF PREFERRED EMBODIMENTS

Figure 1:
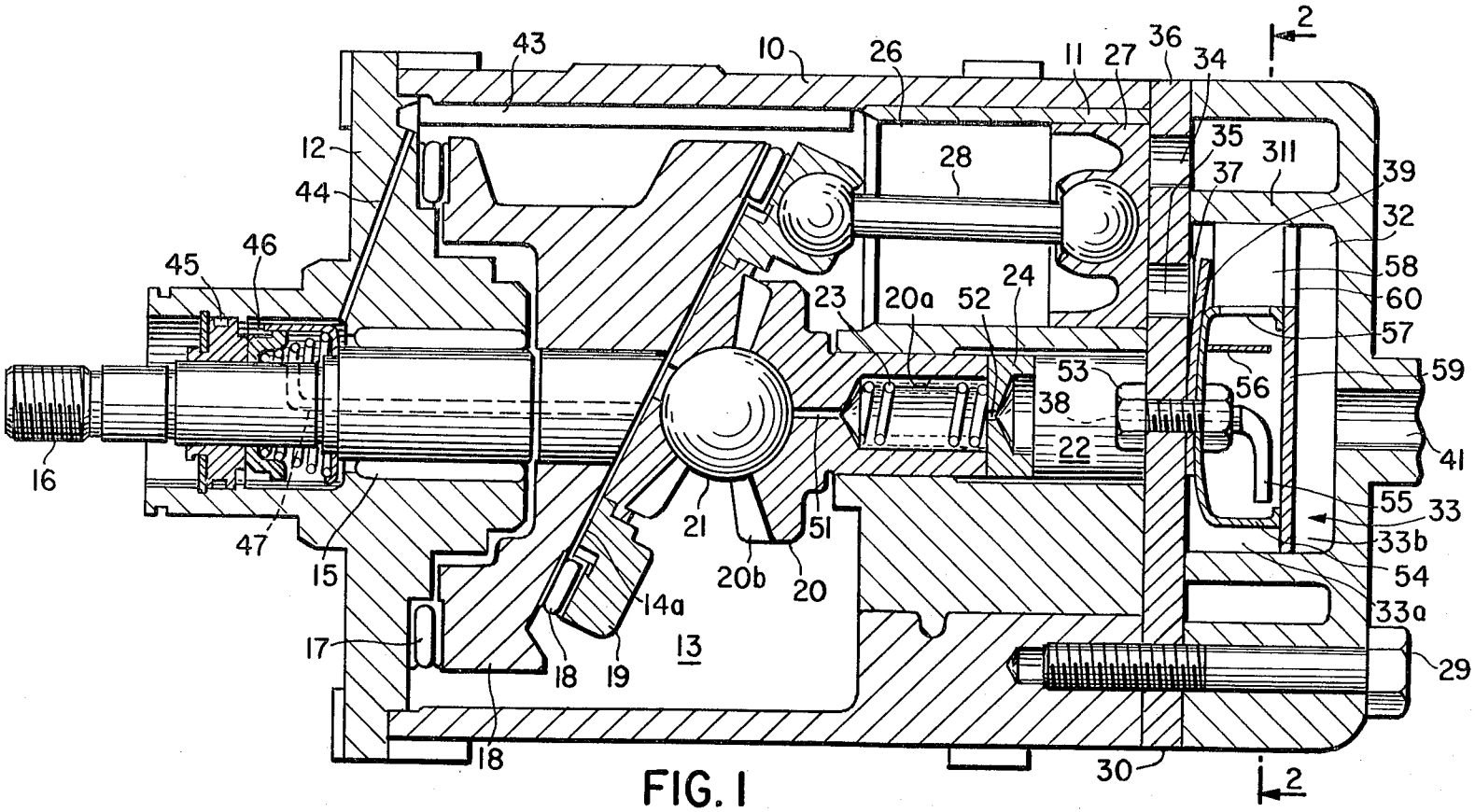
FIG. 1 is a vertical cross-sectional view of a refrigerant compressor unit according to an embodiment of this invention taken along line 1—1 in FIG. 2.

The embodiment of the invention illustrated in FIGS. 1–4 comprises a substantially cylindrical housing 10, a cylinder block 11 which is closely fitted into and secured to the housing 10 at an end thereof, and a front housing or cover plate 12 secured to the other end of the housing 10. The interior of the housing 10 defines a crank chamber 13 between the cylinder block 11 and the front housing 12. A swash plate or a cam rotor 14, which is disposed within the crank chamber 13, is fixedly mounted on an inner end of a main shaft 16. The main shaft 16 extends through a central portion of the front housing 12 outside of a the housing and is rotatably supported by means of bearing such as a needle bearing 15 in the front housing 12. The cam rotor 14 is also supported on the inner surface of the front housing 12 by means of a thrust needle bearing 17. In the crank chamber 13, a wobble plate 19 is also disposed in close proximity with the sloping surface **14*a* of the cam rotor 14 with a thrust needle bearing 18 therebetween. The wobble plate 19 is nutatably but non-rotatably supported on a bearing ball 21 seated at an end of a supporting member 20**.

The supporting member 20 comprises a shank portion having an axial hole 20*a* at its other end and a bevel bear portion 20*b* at the end of the shank portion which has a seat for the bearing ball 21 at its center. The supporting member is axially slidably but non-rotatably supported on the cylinder block 11 by inserting the shank portion into a central axial hole 22 formed in the cylinder block 11. The rotation of the supporting member 20 is prevented by means of a key and a key groove (not shown). A coil spring 23 is disposed in the axial hole 20*a* of the supporting member. The outer end of spring 23 is in contact with a screw member 24 screwed into the central hole 22 of the cylinder block 11, so that the supporting member 20 is urged toward the wobble plate 19. The bevel gear portion 20*b* of the supporting member 20 engages with a bevel gear 25 mounted on the wobble plate 19 so that the rotation of the wobble plate is prevented. The bearing ball 21 is seated in the seat formed at a central portion of the bevel gear portion 20*b* and is also seated in a seat formed at a central portion of the bevel gear 25, so that the wobble plate 19 is nutatably but non-rotatably supported on the bearing ball 21.

The cylinder block 11 is provided with a plurality of axial cylinders 26 formed therein, within which pistons 27 are respectively slidably and closely fitted. The pistons 27 are respectively connected with the wobble plate 19 by a plurality of piston rods 28. The connection between the piston rods and the pistons and the connection between the piston rods and the wobble plate are made by a ball joint mechanism.

On the outer end of the cylinder block 11, a cylinder head 31 is disposed and is secured to the cylinder block by means of bolts 29, interposing a gasket member (not shown) and a valve plate assembly 30 therebetween.

Figure 2:
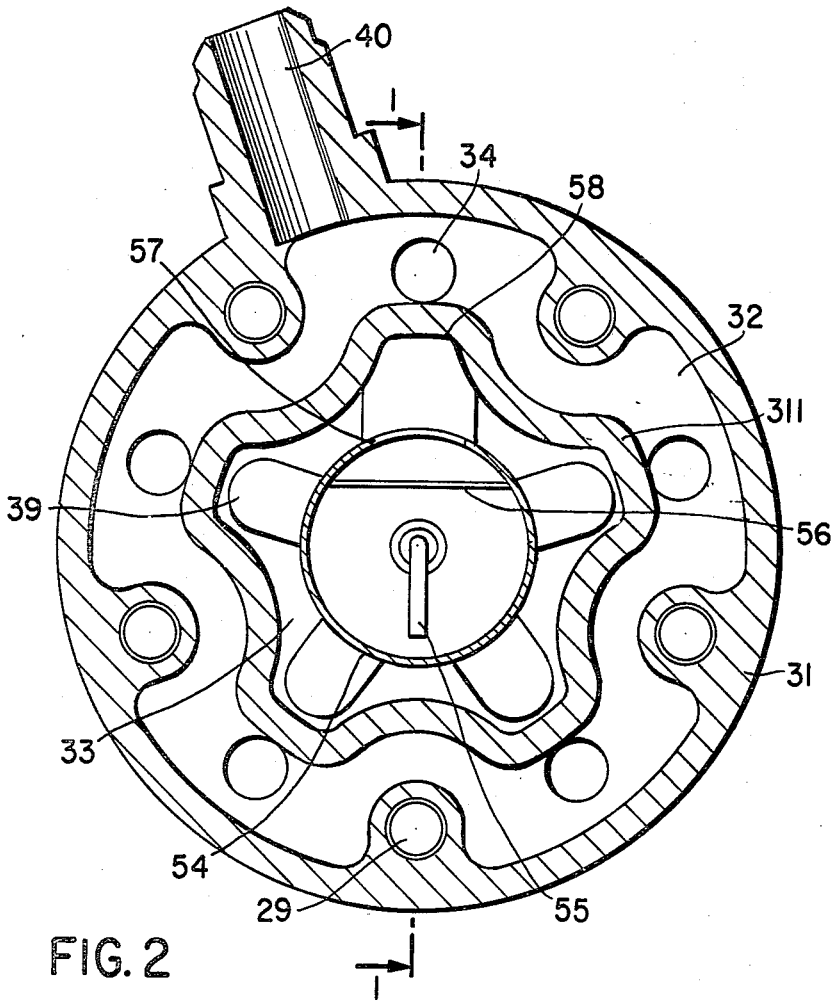
FIG. 2 is a sectional view taken along line 2—2 in FIG. 1.

Referring to FIG. 2, the cylinder head 31 is provided with a suction chamber 32 and a discharge chamber 33 separated by a partition wall 311. The valve plate assembly 30 comprises a valve plate 36 having suction ports 34 connecting between the suction chamber 32 and respective cylinders 26, and discharge ports 35 connecting between the discharge chamber 33 and respective cylinders 26. The valve plate assembly also includes a suction reed valve member (not shown), a discharge reed valve member 37, a stopper plate 39 for suppressing excessive deformation of the discharge reed valve member 37, and bolt-nut means 38 for securing the suction and discharge reed valve members and the stopper member to the valve plate.

In the operation of the compressor as above described, the main shaft 16 is driven by any suitable driving means, such as an automobile engine. The cam rotor 14 rotates together with the main shaft, so that the wobble plate 19 nutates about the bearing ball 21 according to the rotation of the sloping surface 14*a* of the cam rotor 14. The nutation of the wobble plate 19 causes reciprocating movement of respective pistons 27 within cylinders 26. Therefore, the suction and compression of the refrigerant gas is repeatedly performed in each cylinder. Thus, the refrigerant gas circulates through a cooling circuit which is connected between an inlet port 40 and an outlet port 41 of the cylinder housing 31. During the operation of the compressor, a part of refrigerant gas in each cylinder passes into the crank chamber 13 as a blow-by gas through a gap between an inner wall of the cylinder 26 and the piston 27.

Figure 3:
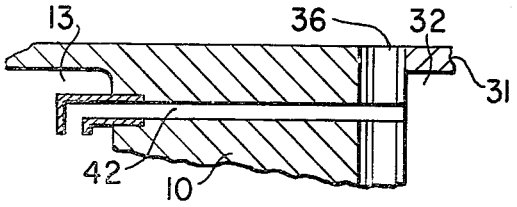
FIG. 3 is a sectional view of a part of the embodiment of FIG. 1 illustrating a balance hole.

As shown best in FIG. 3, in order to return the blow-by gas to the suction chamber 32, a passageway 42, which is a so-called balance hole, is formed in the cylinder block 11 and through the valve plate assembly 30 to communicate between the crank chamber 13 and the suction chamber 32. Lubricating oil contained in the crank chamber is agitated and splashed during the operation of the compressor and lubricates the internal moving parts in the form of an oil mist.

Referring again to FIG. 1, the housing 10 is provided with an oil deflector 43 formed on the inner surface thereof for directing the oil flow along the inner wall of the housing 10 toward the front housing 12, as disclosed in U.S. Pat. No. 4,005,948 to Hiraga. The front housing 12 is provided with an oil passageway 44 which communicates between the crank chamber 13 at the front end of the deflector 43 and a shaft seal cavity 46 formed in the front housing 12, to direct the oil flow to the shaft seal cavity 46. A shaft seal assembly 45 is disposed in the shaft seal cavity on the main shaft 16 extending therein. The main shaft 16 is provided with an oil passageway 47 which communicates between the shaft seal cavity 46 and the crank chamber 13. Accordingly, oil flowing along the inner surface of the housing 10 is directed to the oil passageway 44 by the deflector 43, and flows into the shaft seal cavity 46. A part of the oil returns from the shaft seal cavity to the crank chamber 13 thereby lubricating the needle bearing 15 supporting the main shaft and the thrust needle bearing 17. The other part of the return oil flows through the oil passageway 47 into the crank chamber 13 for lubricating the needle bearing 18.

A part of the agitated oil mist in the crank chamber flows into the suction chamber 32 together with the returning refrigerant gas through the balance hole 42, and is sucked into respective cylinders to lubricate the gap between the pistons and the inner walls of the cylinders. But a part of the oil mist is discharged to the discharge chamber together with the compressed refrigerant gas and, therefrom, circulates into the cooling circuit. The leakage of oil to the cooling circuit could cause various disadvantages as described hereinabove. In the refrigerant compressor unit of the invention, means as described more completely below is provided for preventing oil from flowing through the cooling circuit and for returning the oil flowing into the discharge chamber to the crank chamber.

As shown in FIG. 1, the supporting member 20, screw member 24 and the bolt 38 are provided with axial central oil passageways 51, 52, and 53, respectively, so that the crank chamber 13 communicates with the discharge chamber 33 through the passageways. An oil receiving member 54 for receiving oil separated by an oil separator described hereinafter is disposed in the discharge chamber 33 by being secured to the valve plate assembly 30 by the bolt 38. An oil pick-up tube 55 is fixed to the end of the bolt 38 and communicates with the axial passageway 53 of the bolt 38. The end of the tube is curved downwardly in the oil receiving member 54. The oil receiving member 54 is in the form of a container having a top-opening 57, and has a horizontal plate 56 near the top opening 57. The oil separator 58 is disposed in the discharge chamber above the top opening 57 of the oil receiving member 54. The oil separator 58 is formed of a material such as porous materials, screen and the like to be able to separate oil from the mixture of refrigerant gas and oil mist passing therethrough. A rear plate 59 is fixedly disposed in the rear of, and in contact with, the oil receiving member 54 in the discharge chamber 33 and is fixed to the partition wall 311 to separate the discharge chamber 33 into two chambers 33*a* and 33*b*. The rear plate 59 may be secured to the cylinder head by means of bolts. The oil receiving member 54 and the oil separator 58 are disposed in the chamber 33*a* which communicates with discharge ports 35, and the other chamber 33*b* communicates with the outlet port 41.

Figure 4:
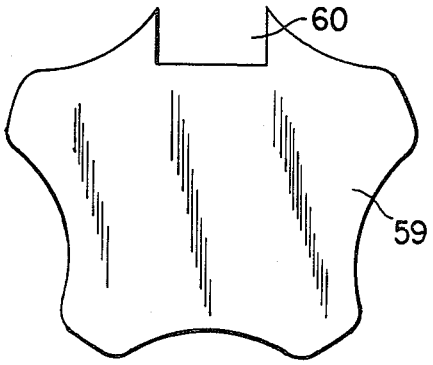
FIG. 4 is a plan view of a rear plate used in the embodiment of FIG. 1.

As shown in FIG. 4, the rear plate 59 is provided with a cut-away portion or opening 60, which is registered to the oil separator 58, so that the gas passing the oil separator flows into the chamber 33*b*.

In operation, the mixture of oil mist and refrigerant gas, which is compressed in the cylinders and discharged into the discharge chamber 33, passes through the oil separator 58 where oil is separated from the oil-gas mixture. The separated oil falls down into the oil receiver 54 under the oil separator 58, and the refrigerant gas flows into the chamber 33*b* from which the refrigerant gas circulates to the cooling circuit through the outlet port 41. The oil accumulated in the oil receiver 54 flows into the axial central hole 22 through the pick-up tube 55 and the passageway 53 of the bolt 38, and further flows through the passageways 52 and 51 of the screw member 24 and the supporting member 20 into the crank chamber 13 thereby lubricating the bearing ball 21. Thus, the oil is prevented from circulating through the cooling circuit. The horizontal plate 56 serves to block the gas flow from agitating the oil accumulated in the oil receiving member 54.

In the embodiment of the invention illustrated in FIGS. 1–4, the oil separated from the compressed gas returns to the crank chamber through the passageways of the bolt, screw member and supporting member, but may be returned through any different passageway.

Figure 5:
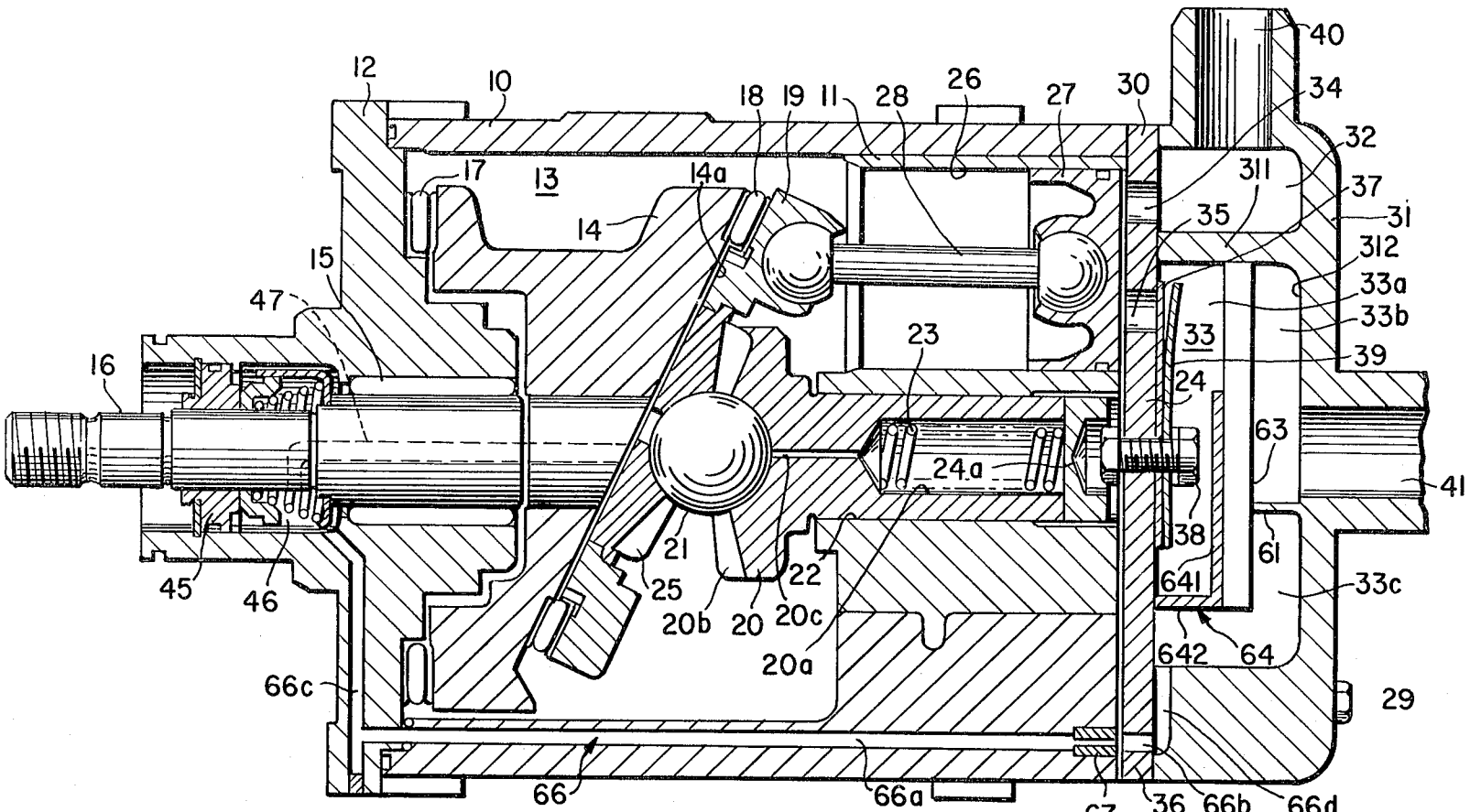
FIG. 5 is a vertical cross-sectional view of a refrigerant compressor unit according to another embodiment of this invention.
Figure 6:
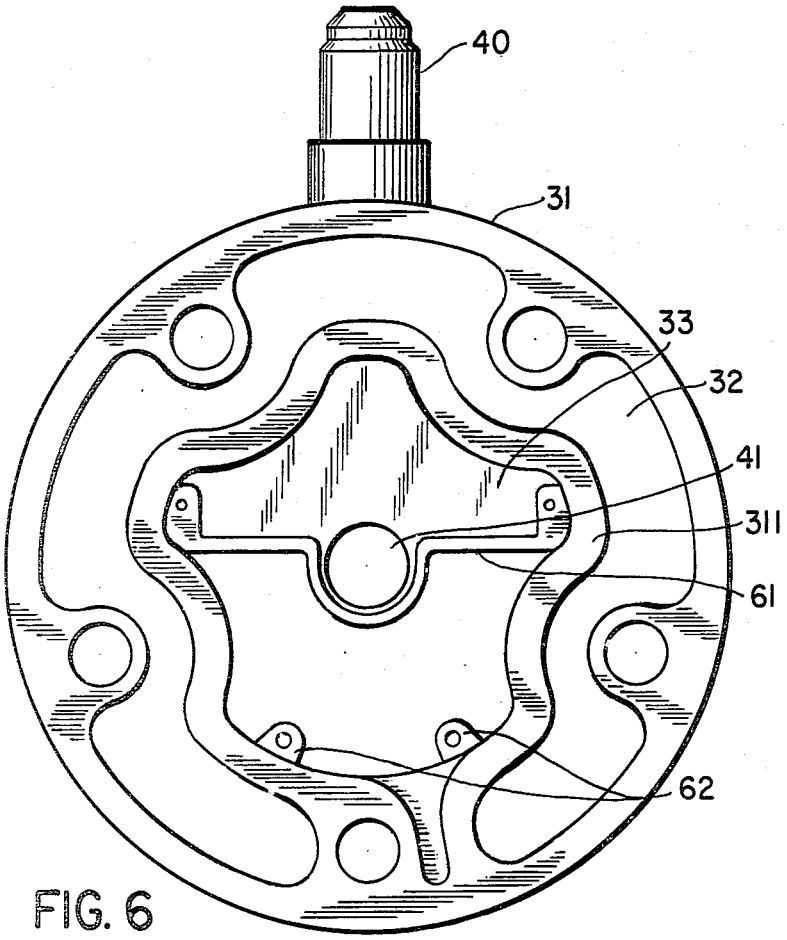
FIG. 6 is a front view of a cylinder head used in the embodiment of FIG. 5.
Figure 7:
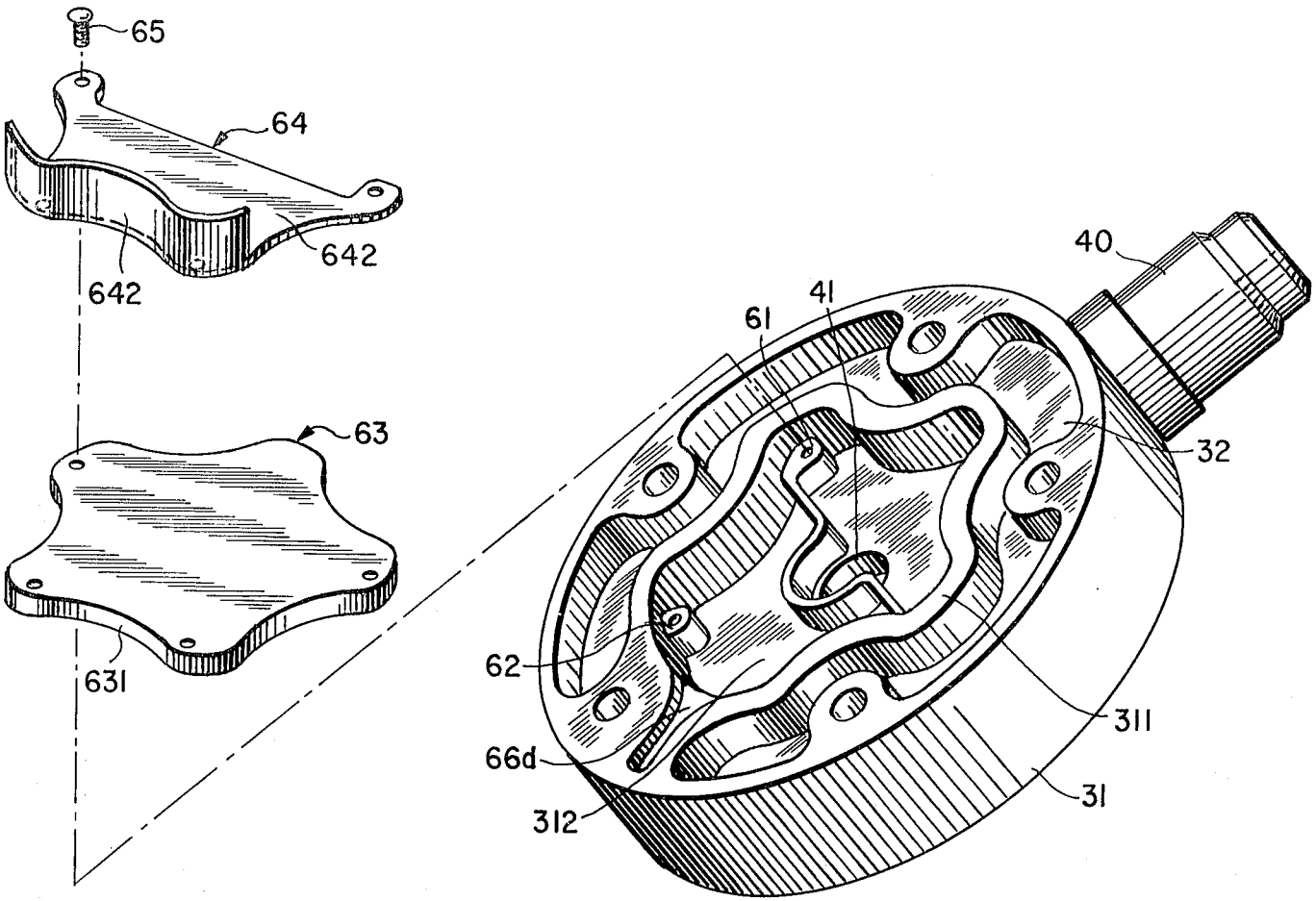
FIG. 7 is an exploded perspective view of the cylinder head with the oil separating means of the embodiment of FIG. 5.

In the embodiment of the invention illustrated in FIGS. 5–7, the separated oil is introduced into the shaft seal cavity 46 and, thereafter, is returned to the crank chamber. Therefore, the deflector 43 and the oil passageway 44 of the front housing 12 are omitted in this embodiment. In other respects parts that are similar to the embodiment of FIGS. 1–4 are represented by the same reference numerals as in that embodiment, and the description of these similar parts is omitted for the purpose of simplification of the description.

The cylinder head 31 in the embodiment of FIGS. 5–7 is provided with a wall 61 projecting from the inside surface 312 of the end wall thereof in the discharge chamber 33 and transversely extending in the discharge chamber 33 to connect with the partition wall 311 at opposite positions, as shown in FIGS. 6 and 7, so that the discharge chamber 33 is separated into an upper chamber portion connecting with the outlet port 41 and a lower chamber portion. The axial length of the projecting wall 61 is short of that of the partition wall 311. In the lower chamber portion, small projections 62 (two projections are shown) are formed to inwardly project from the inside surface of the partition wall 311 so that the axial side surface of each small projection 62 lies in the same radial plane as the axial end surface of the wall 61.

An oil separator plate 63 made of a material, such as porous materials, a screen and the like, is disposed in the discharge chamber 33 and is received on the axial end surface of the projecting wall 61 and the axial side surfaces of the small projections 62. The oil separator plate 63 is formed in a shape consistent with the internal shape of the partition wall 311, but is partially cut away as shown at 631 at a peripheral portion thereof corresponding to the lower chamber portion. Thus, the discharge chamber 33 is separated by the oil separator plate 63 into three chamber portions 33*a*, 33*b*, and 33*c*. The first chamber portion 33*a* is a portion adjacent the valve plate assembly 30, another, or second, chamber portion 33*b* being the upper portion than the projecting wall 61 which portion is defined by the partition wall 311, the oil separator plate 63 and the projecting wall 61, and the other, or third, chamber portion 33*c* being the lower portion than the projecting wall 61 which portion is partially communicating with the first chamber portion 33*a* through the cut-away portion 631 of the oil separator plate 63.

In order to separate the lower chamber portion 33*c* from the chamber portion 33*a*, a partition plate 64 is also disposed in the discharge chamber 33. The partition plate 64 comprises a plate portion 641 covering the oil separator plate 63 except at at least a part of a portion thereof defining the upper chamber portion 33*b*, and an axial flange. Portion 642 axially extends toward the valve plate assembly 30 from the plate portion 641 at the lower end corresponding to the cut-away portion 631 of the oil separator plate 63. The axial end of the axial flange portion 642 is in contact with the valve plate assembly 30. Therefore, the first chamber portion 33*a* is separated from the third chamber portion 33*c*. The third chamber portion 33*c* is defined by the projecting wall 61, the partition plate 64 and the valve plate assembly 30. The partition plate 64 should be disposed so that all discharge ports 35 communicate with the first chamber portion 33*a*.

The oil separator plate 63 and the partition plate 64 are secured to the cylinder head 31 by bolt means as shown at 65 in FIG. 7. These may be secured to the valve assembly 30.

In the operation of the embodiment of FIGS. 5–7 the mixture of the refrigerant gas and oil mist compressed in the cylinders flows into the first chamber portion 33*a* of the discharge chamber 33 through respective discharge ports 35, and, passes from chamber portion 33*a* through the oil separator plate 63 into the second chamber portion 33*b*. At the oil separator plate 63, oil mist is separated from the refrigerant gas and flows down along the oil separator plate 63 into the lower chamber portion 33*c*. The separated refrigerant gas flows into the upper chamber portion 33*b* from which it circulates to the cooling circuit through the outlet port 41. In this manner oil is prevented from circulating to the cooling circuit and from accumulating in the lower chamber portion 33*c*.

In this embodiment, an oil passageway 66 is formed to communicate the lower chamber portion 33*c* with the shaft seal cavity 46 in order to return the separated and accumulated oil into the crank chamber 13. The oil passageway 66 comprises a first oil hole 66*a* axially extending through the side wall of the cylindrical housing 10, a second oil hole 66*b* axially formed in the valve plate assembly 30 in registry with the first oil hole 66*a*, a third oil hole 66*c* formed in the front housing 12 to communicate the first oil hole 66*a* with the shaft seal cavity 46, and a fourth oil hole 66*d* formed in the cylinder head 31 to connect the second oil hole 66*b* with the lower chamber portion 33*c*. Thus, the separated and accumulated oil in the lower chamber portion 33*c* flows into the shaft seal cavity 46 through the oil passageway 66 and returns to the crank chamber 13 after lubricating needle bearings 15, 17, and 18.

An orifice member 67 is disposed in the oil hole 66*a* to prevent the compressed refrigerant gas from leaking to the crank chamber 13 through the oil passageway 66. If any one of oil holes 66a–66d is sufficiently small to prevent the gas from flowing from the chamber portion 33c to the crank chamber 13 through the oil passageway 66, the orifice 67 need not be used.

Furthermore, in this embodiment, the supporting member 20 is formed with an axial small hole 20c extending between the ball seat of the end surface thereof and the axial hole 20a. The screw member 24 is also formed with an axial hole 24a. Accordingly, the high pressure mixture gas leaks from the first chamber portion 33a of the discharge chamber to the axial central hole 22 of the cylinder block 11 through a gap along the peripheral surface of the bolt 38, and the leaked gas flows to the bearing ball 21 through the holes 24a, 20a, and 20c so that the bearing ball 21 is lubricated.

Figure 8:
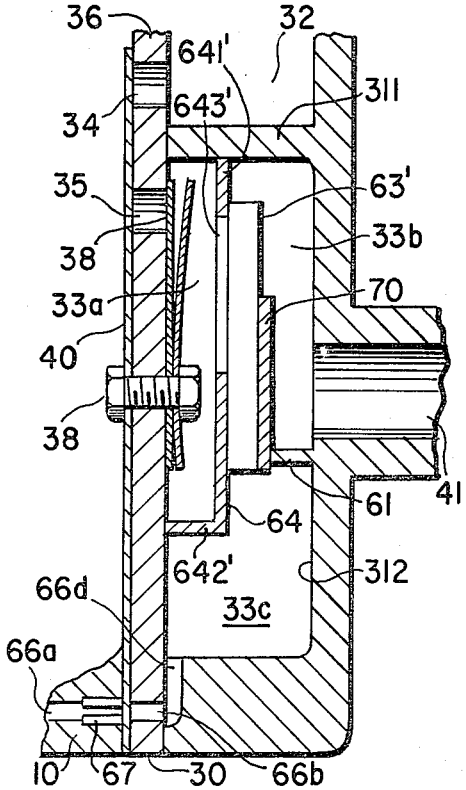
FIG. 8 is a vertical sectional view of a main part of a refrigerant compressor unit according to a further embodiment of this invention.
Figure 9:
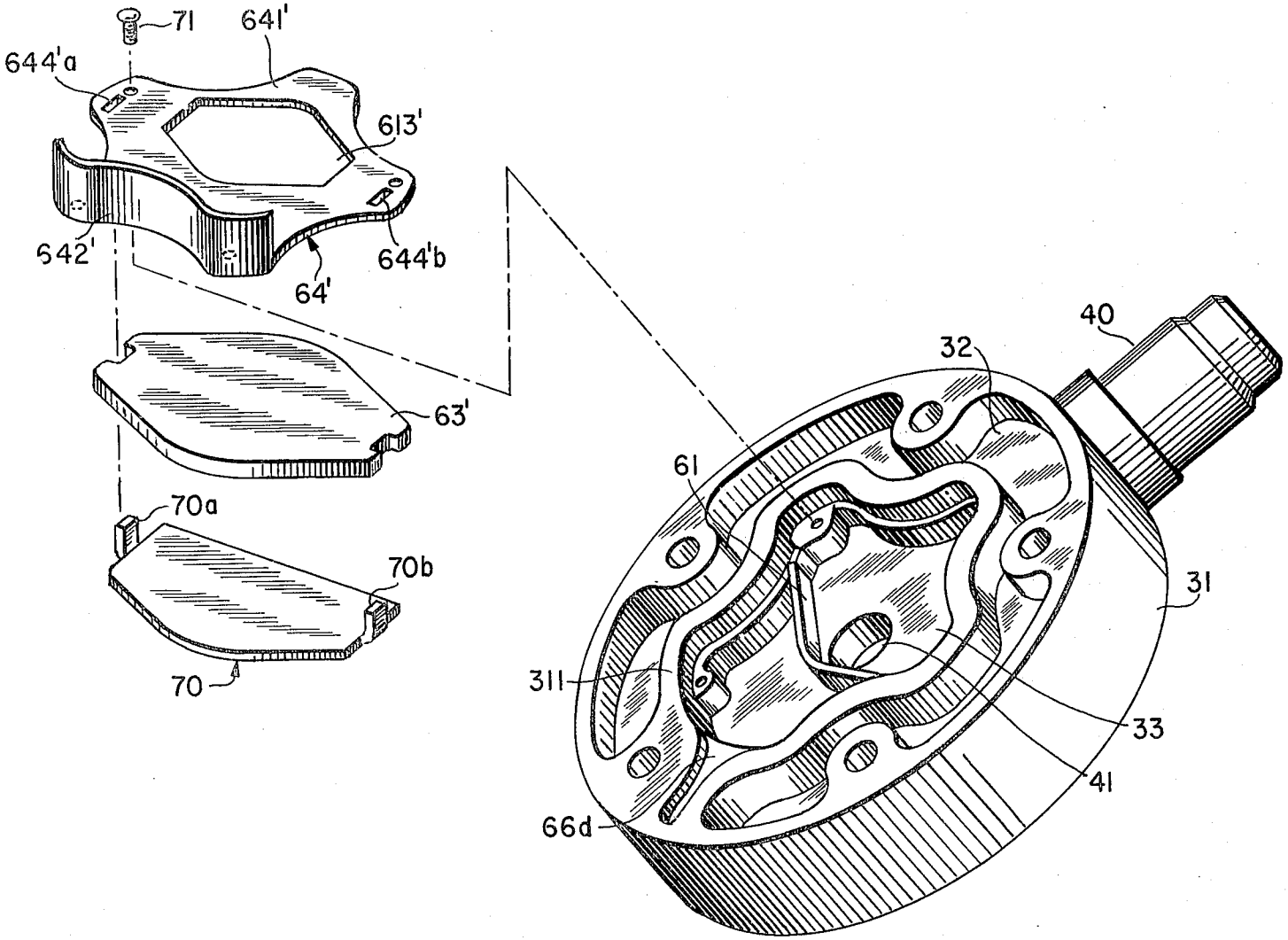
FIG. 9 is an exploded perspective view of the cylinder head with the oil separating means used in the embodiment of FIG. 8.

FIGS. 8 and 9 show a modification of the embodiment as shown in FIGS. 5–7, in which a back-up plate 70 is used in the second chamber portion 33b of the discharge chamber 33 at the rear end of the oil separator plate 63, and a partition plate 64' has a window 643' at the plate portion 641' thereof.

The partition plate 64' comprises a plate portion 641' covering over the second chamber portion 33b and an axial flange portion 642' similar to the flange portion 642 of the partition plate 64 in the embodiment of FIG. 5, and the window 643' formed in the plate portion 641' at a location corresponding to the second chamber portion 33b. The oil separator plate 63' is interposed between the partition plate 64' and the back-up plate 70 to cover the window 643' of the plate portion 641', with the lower end of the oil separator plate 63' being exposed in the lower chamber portion 33c. The back-up plate 70 covers over the oil separator plate 63' in the second chamber portion 33b except at an area corresponding to at least a part of the window 643'. Accordingly, the mixture of the refrigerant gas and oil mist discharged into the first chamber portion 33a through the discharge ports passes through the window 643' and the oil separator plate 63' into the second chamber portion 33b, after oil mist is removed at the oil separator plate 63', and is circulated to the cooling circuit through the outlet port 41. The separated oil at the oil separator plate 63' flows down along the separator plate and is accumulated in the lower chamber portion 33c.

In this embodiment, the oil captured by, and maintained in, the oil separator plate 63' is prevented from flowing into and being sprayed into the second chamber portion 33b by the back-up plate 70.

The back-up plate 70 may be secured to the partition plate 64' by means of tabs 70a and 70b, as shown in FIG. 9, holding the oil separator plate 63' therebetween. As also shown in FIG. 9, the partition plate 64' is formed with small openings 644'a and 644'b for receiving tabs 70a and 70b of the back-up plate 70. The tabs 70a and 70b are inserted into the openings 644'a and 644'b of the partition plate 64' interposing the oil separator plate 63' and the ends of tabs are bent, so that the oil separator plate 63' and the back-up plate 70 are secured to the partition plate 64' to form an assembly. The assembly is disposed in the discharge chamber 33, and is assembled into the cylinder head by securing the partition plate 64' by bolt means shown by 71 in FIG. 9.

Although the invention has been described in detail in connection with preferred embodiments referring to compressors of a specific type, it will be appreciated that these are only for exemplification, and it is understood that other modifications and various designations may be made by those skilled in the art without necessarily departing from the spirit and scope of this invention.

What is claimed is:

1. In a refrigerant compressor unit comprising a compressor housing, a cylinder block mounted therein and having a plurality of cylinders, a plurality of piston means respectively slidably received within said plurality of cylinders, means for driving said piston means within said cylinders to compress refrigerant gas therein, said compressor housing having a first chamber adjacent said cylinder block for containing said driving means, a cylinder head having a suction chamber and a discharge chamber which operatively communicate with said cylinders, and a gas passageway communicating between said first chamber and said suction chamber to return blow-by gas in said first chamber to said suction chamber, the improvement which comprises: partitioning means for separating said discharge chamber of said cylinder head into first, second and third chamber portions, said first chamber portion communicating with said cylinders, said second chamber portion communicating with an outlet port to be connected to an external gas-circulating system and communicating with said first portion through a first opening formed in said partitioning means therebetween, means disposed to cover said first opening of said partitioning means for separating oil from the compressed gas flowing therethrough, said third chamber portion having a second upper opening in said partitioning means and disposed below said oil separating means to cover said second opening therewith for directly receiving and accumulating oil separated by said oil separating means, and an oil passageway communicating between said third chamber portion and said first chamber for returning the separated oil to said first chamber.

2. The improvement as claimed in claim 1, wherein said driving means comprises a drive shaft extending through a front end of said compressor housing, a cam rotor mounted on an inner end of the drive shaft, a wobble plate mounted on an inclined surface of said cam rotor and connected with said piston means, and a bearing ball nutatably supporting said wobble plate seated in a ball seat, said oil passageway communicating between said oil accumulating third chamber portion and said ball seat, whereby the separated oil is returned to said first chamber for lubricating said bearing ball.

3. The improvement as claimed in claim 1, wherein said driving means comprises a drive shaft supported in a front end of said compressor housing and outwardly extending through said front end and having a shaft seal cavity, a cam rotor mounted on an inner end of said drive shaft, a wobble plate mounted on an inclined surface of said cam rotor through a bearing means and connected with said piston means, and supporting means for nutatable but non-rotatably supporting said wobble plate, wherein said oil passageway communicates between said oil accumulating third chamber portion and said shaft seal cavity, whereby the separated oil is returned to said first chamber through said shaft seal cavity and said bearing means supporting said drive shaft.

4. The improvement as claimed in claim 3, wherein said oil flowing passageway is formed through said compressor housing wall.

5. The improvement as claimed in claim 3 or 4, wherein said drive shaft is formed with a second oil passageway communicating between said shaft seal cavity and a gap between said cam rotor and said wobble plate, whereby a part of the oil in said shaft cavity is returned to said first chamber after lubricating said bearing means between said cam rotor and said wobble plate.

6. The improvement of claim 1, wherein said partitioning means comprises an oil-receiving member defining said separated oil receiving third chamber portion and having said second upper opening, and a rear plate fixed to said oil-receiving member and separating said discharge chamber into said first and second chamber portions, said oil-receiving member and said oil separating means being located in said first chamber portion.

7. The improvement of claim 6, wherein said oil-receiving member includes a horizontal plate adjacent said upper opening for blocking the flow of gas from agitating the oil accumulated in said oil-receiving member.

8. The improvement of claim 1, in which said oil separating means comprises a part of said partitioning means, said partitioning means further comprising a partition plate in said discharge chamber and covering a portion of said oil-separating means.

9. The improvement of claim 8, in which said partitioning means further includes a projecting wall transversely extending from said cylinder head to said oil-separating means.

10. The improvement of claim 8, in which said partition pate includes an opening at a location corresponding to said second chamber portion, and a back-up plate, said oil-separating means being interposed between said partition plate opening and said opening, the lower end of said oil-separating means being exposed to said third chamber portion.

* * * * *